US006602314B1

(12) United States Patent
Sakaguchi et al.

(10) Patent No.: US 6,602,314 B1
(45) Date of Patent: Aug. 5, 2003

(54) ALUMINUM COMPOSITE MATERIAL HAVING NEUTRON-ABSORBING ABILITY

(75) Inventors: Yasuhiro Sakaguchi, Takasago (JP); Tomikane Saida, Takasago (JP); Kazuo Murakami, Kobe (JP); Kazuhisa Shibue, Tokyo (JP); Naoki Tokizane, Tokyo (JP); Tatsumi Takahashi, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/787,912

(22) PCT Filed: Jul. 27, 2000

(86) PCT No.: PCT/JP00/05021

§ 371 (c)(1),
(2), (4) Date: Mar. 30, 2001

(87) PCT Pub. No.: WO01/09903

PCT Pub. Date: Feb. 8, 2001

(30) Foreign Application Priority Data

Jul. 30, 1999 (JP) ..... 11-218185

(51) Int. Cl.[7] ..... B22F 3/00

(52) U.S. Cl. ..... 75/249; 75/238; 75/244; 419/14; 419/23; 419/48; 419/49; 419/50

(58) Field of Search ..... 75/238, 249, 244; 419/14, 23, 48, 49, 50

(56) References Cited

U.S. PATENT DOCUMENTS

| | | | | | |
|---|---|---|---|---|---|
| 4,027,377 | A | * | 6/1977 | Roszler | |
| 4,557,893 | A | * | 12/1985 | Jatkar et al. | 419/12 |
| 4,605,440 | A | * | 8/1986 | Halverson et al. | 75/238 |
| 4,631,236 | A | * | 12/1986 | Roczyn | 428/558 |
| 4,923,532 | A | * | 5/1990 | Zedalis et al. | 148/159 |
| 5,624,475 | A | * | 4/1997 | Nadkarni et al. | 75/238 |
| 5,700,962 | A | | 12/1997 | Carden | |

FOREIGN PATENT DOCUMENTS

| | | |
|---|---|---|
| JP | 3-36231 | 2/1991 |
| JP | 3-82732 | 4/1991 |

* cited by examiner

*Primary Examiner*—Ngoclan Mai
(74) *Attorney, Agent, or Firm*—Oblon, Spivak, McClelland, Maier & Neustadt, P.C.

(57) ABSTRACT

The present invention provides an aluminum composite material having neutron absorbing power that improves the ability to absorb neutrons by increasing the content of B, while also being superior to materials of the prior art in terms of mechanical properties and workability. The aluminum composite material having neutron absorbing power contains in Al or an Al alloy matrix phase B or a B compound having neutron absorbing power in an amount such that the proportion of B is 1.5% by weight or more to 9% by weight or less, and the aluminum composite material has been pressure sintered.

29 Claims, 5 Drawing Sheets

ALUMINUM COMPOSITE MATERIAL HAVING NEUTRON-ABSORBING ABILITY

TECHNICAL FIELD

The present invention relates to an aluminum composite material having neutron absorbing power that is useful as, for example, a structural material of a transport container or storage container and so forth of spent nuclear fuel, and its production method.

BACKGROUND ART

Although boron (B) is an element that has the action of absorbing neutrons, only the $^{10}B$ isotope, which is present at a proportion of about 20% in naturally-occurring B, is known to actually have said action. Alloys in which B is added to an Al alloy have been used in the past as structural materials having neutron absorbing action.

Ordinary melting methods have been employed in the case of producing such an alloy. Since the liquidus temperature rises rapidly as the amount of B added increases however, various methods are used, including adding B to the Al alloy in the form of a powder or Al—B alloy, adding B to an Al melt in the form of a borofluoride such as $KBF_4$ to form an Al—B intermetallic compound, and using a casting or pressurized casting method starting at a temperature equal to or below the liquidus temperature at which both liquid and solid are present. However, various improvements have been made to enhance mechanical properties such as strength and ductility. There are numerous examples of these improvements, some of which include Japanese Unexamined Patent Application, First Publication No. Sho 59-501672, Japanese Unexamined Patent Application, First Publication No. Sho 61-235523, Japanese Unexamined Patent Application, First Publication No. Sho 62-70799, Japanese Unexamined Patent Application, First Publication No. Sho 62-235437, Japanese Unexamined Patent Application, First Publication No. Sho 62-243733, Japanese Unexamined Patent Application, First Publication No. Sho 63-312943, Japanese Unexamined Patent Application, First Publication No. Hei 1-312043, Japanese Unexamined Patent Application, First Publication No. No. Hei 1-312044 and Japanese Unexamined Patent Application, First Publication No. Hei 9-165637.

In Al—B alloy according to this type of melting method, when B is added that absorbs neutrons, intermetallic compounds such as $AlB_2$ and $AlB_{12}$ are present as B compounds, and when a large amount of $AlB_{12}$ in particular is present, workability decreases. However, since it is technically difficult to control the amount of this $AlB_{12}$, addition of the amount of B up to 1.5% by weight is the limit for practically used materials, and thus, neutron absorbing effects are not that large.

In addition, borals are materials other than the Al—B alloy according to the melting methods described above that have neutron absorbing action. This boral is a material in which a powder, in which 30–40% by weight of $B_4C$ is blended into an Al matrix material, is sandwiched followed by rolling. However, not only is the tensile strength of this boral low at about 40 MPa, since its elongation is also low at 1% making molding and forming difficult, it is currently not used as a structural material.

An example of a production method of Al—$B_4C$ composite materials that still leaves something to be desired involves the use of powder metallurgy. This method consists of uniformly mixing Al alloy and $B_4C$ both in the state of a powder followed by solidifying and molding. In addition to being able to avoid the above problems accompanying melting, this method offers advantages including greater freedom in selecting the matrix composition. In U.S. Pat. No. 5,486,223 and a series of following patents by the same inventor, a method is described for obtaining an Al—$B_4C$ composite material having superior strength characteristics using a powder metallurgy method. In particular, U.S. Pat. No. 5,700,962 focuses on the production of a neutron-blocking material. However, in these inventions, due to the use of a special $B_4C$ to which specific elements are added to improve binding with the matrix, the process is complex, and there were considerable problems in terms of cost for practical application. In addition, there were also numerous areas of concern with respect to performance, such as the occurrence of gas contamination as a result of heating and extrusion of a porous molded article in which the powder is solidified with CIP only, and significant deterioration of characteristics as a result of exposing to a high temperature of 625° C. or higher during billet sintering depending on the matrix composition.

As described above, since there are limitations on the added amount of a compound having neutron absorbing power such as B in Al alloy produced with a melting method, the neutron absorbing effects were small. In order to resolve this problem, although numerous inventions have been made as mentioned above, in order to work those inventions, there were many prerequisites that considerably raised production cost, including melting a master alloy in which the ratios of internal compound phases ($AlB_2$, $AlB_{12}$ and others) have been controlled, and using extremely expensive concentrated boron, thus making these inventions difficult to apply practically at the industrial level. In addition, in terms of the operation, the working of these inventions with ordinary Al melting equipment has been nearly practically impossible due to problems such as contamination of the inside of the furnace (such as requiring that the furnace be washed to remove dross having a high B concentration, and contamination resulting from residual fluorides that were loaded into the furnace), and damage to the furnace materials caused by a high melting temperature (requiring a temperature of 1200° C. and above in some cases).

In addition, a boral having a high $B_4C$ content of 30–40% by weight has problems with workability, preventing it from being used as a structural material.

In consideration of these background circumstances, in addition to seeking high neutron absorbing power by increasing the content of B, there has been a need for an aluminum composite material having neutron absorbing power, and its production method, that has superior mechanical properties such as tensile strength and elongation, is easily worked and can be used as a structural material.

DISCLOSURE OF INVENTION

Therefore, the object of the present invention is to provide an aluminum composite material having neutron absorbing power, and its production method, that enables the neutron absorbing power to be enhanced by increasing the B content, and is superior in terms of mechanical properties and workability.

In consideration of the present circumstances as described above, together with creating a method for inexpensively producing an Al composite material that satisfies the necessary neutron absorbing power and strength characteristics in the proper balance by using ordinary inexpensive $B_4C$ available on the market as an abrasive or refractory material, the inventors of the present invention found an alloy composition (including the amount of $B_4C$ added) in which the maximum effects of this method are demonstrated.

The present invention employed the following means to solve the above problems.

An aluminum composite material having neutron absorbing power of the present invention is characterized in that it contains in Al or an Al alloy matrix phase B or a B compound having neutron absorbing power in an amount such that the proportion of B is 1.5% by weight or more to 9% by weight or less, and that the aluminum composite material has been pressure sintered.

In this case, the B or B compound having neutron absorbing power contained in the Al or Al alloy matrix phase is preferably such that the proportion of B is 2% by weight or more and 5% by weight or less.

According to this aluminum composite material having neutron absorbing power, the amount of B or B compound added is high, and tensile characteristics and other mechanical properties are superior. In addition, its production cost can be held to a low level.

The production method of an aluminum composite material having neutron absorbing power of the present invention comprises adding a B or B compound powder having neutron absorbing power in an amount such that the proportion of B is 1.5% by weight or more to 9% by weight or less to an Al or Al alloy powder, and pressurized sintering the powder.

In this case, it is preferable to use a rapidly solidified powder having a uniform, fine composition for the Al or Al alloy powder, while boron carbide ($B_4C$) particles are preferably used as the B compound powder. The mean particle size of the above Al or Al alloy powder is preferably 5–150 $\mu$m, and $B_4C$ particles having a mean particle size of 1–60 $\mu$m are preferably used as the B compound particles used.

In addition, hot extrusion, hot rolling, hot hydrostatic pressing or hot pressing, or any of their combinations, can be used as the method of pressurized sintering.

These pressurized sintering methods are all characterized by charging a powder into a can (canning) followed by drawing a vacuum while heating to remove the gas components and moisture adsorbed on the surface of the powder inside the can, and finally sealing the can. This canned powder is then subjected to heat processing while maintaining the vacuum inside the can.

Moreover, after performing the above pressurized sintering, heat treatment is preferably suitably performed as necessary.

According to this production method of an aluminum composite material having neutron absorbing power, by employing a powder metallurgy method using pressurized sintering, an aluminum composite material can be produced that has superior tensile characteristics and other mechanical properties even if the amount of B or B compound added is increased. Thus, an aluminum composite material can be provided that is able to improve neutron absorbing power while also having superior workability.

BEST MODE FOR CARRYING OUT THE INVENTION

Figure 1:
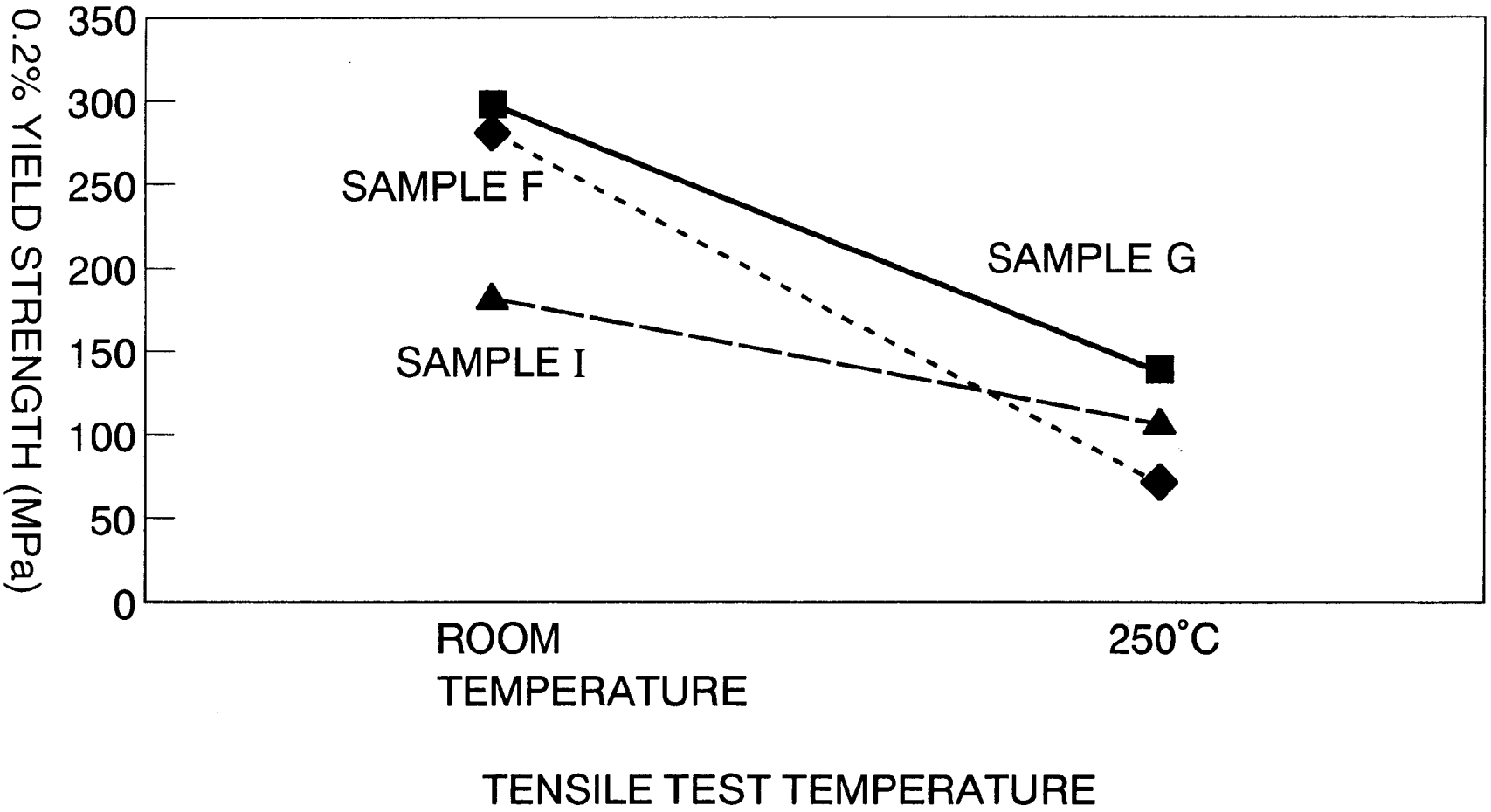
FIG. 1 is a graph relating to the mechanical properties of an Al composite material having neutron absorbing power according to the present invention, and shows the relationship between 0.2% yield strength (MPa) and temperature (°C.) for samples F, G and I of Table 2.

The following provides an explanation of an embodiment of an aluminum composite material, and its production method, having neutron absorbing power as claimed in the present invention, along with a description of the reasons for limiting the ranges of each parameter.

The production method of an Al composite material in the present invention involves mixing an Al or Al alloy powder produced with a rapid solidification method such as atomization with a B or B compound powder having neutron absorbing power followed by pressurized sintering. Here, the amount of B added is within the range of 1.5% by weight or more to 9% by weight or less.

Examples of the Al or Al alloy powder that can be used as the base include pure aluminum metal (JIS 2xxx series), Al—Mg-based aluminum alloy (JIS 5xxx series), Al—Mg—Si-based aluminum alloy (JIS 6xxx series), Al—Zn—Mg-based aluminum alloy (JIS 7xxx series) and Al—Fe-based aluminum alloy (having an Fe content of 1–10% by weight), as well as Al—Mn-based aluminum alloy (JIS 3xxx series). There are no particular restrictions on the base, and it can be selected according to the required characteristics such as strength, ductility, workability and heat resistance.

Rapidly solidified powders having a uniform, fine structure are used as these Al or Al alloys. Examples of rapid solidification methods that can be employed for obtaining this rapidly solidified powder include known technologies such as single rolling, dual rolling or air atomization, gas atomization and other atomization methods. The Al alloy powder obtained by rapid solidification in this manner is preferably used that has a mean particle size of 5–150 $\mu$m.

The reason for this is that, since the particles end up aggregating due to being in the form of fine particles if the mean particle size is less than 5 $\mu$m, the particles eventually take on the form of large clumps and place limitations on production by atomization (because it becomes necessary to remove only fine particles, the powder production yield is worsened considerably resulting in a sudden increase in costs). If the mean particle size exceeds 150 $\mu$m, there are limitations on product by atomization since they are no longer solidify by rapid-cooling. In addition, there are also problems in terms of the difficulty in uniformly mixing with fine added particles. Thus, the most preferable mean particle size is 50–120 μm.

The rapid cooling rate of rapid solidification is $10^{2°}$ C./sec or more, and preferably $10^{3°}$ C./sec or more.

On the other hand, the B or B compound mixed with the above Al or Al alloy powder has the characteristic of having the ability to absorb particularly high-speed neutrons. Furthermore, examples of preferable B compounds that can be used in the present invention include $B_4C$ and $B_2O_3$. $B_4C$ in particular has a high B content per unit amount, and allows the obtaining of powerful neutron absorbing power even if added in small amounts. In addition, it is particularly preferable as a particle added to structural materials having an extremely high hardness and so forth.

The amount added of this B or B compound is such that the proportion of B in percent by weight is 1.5 or more to 9 or less, and preferably 2 or more to 5 or less. The reason for this is as described below.

In the case of considering the use of aluminum alloy (and aluminum-based composite material) as a structural material in the field of nuclear power, and more specifically, as a structural material of a storage or transport container of spent nuclear fuel, the thickness of the members is necessarily from about 5 to 30 mm. In the case of a thick-walled material that exceeds this range, it becomes pointless to use a light aluminum alloy, while on the other hand, in order to secure adequate reliability required by structural materials, it is clear that it would be difficult to use an extremely thin-walled member in consideration of the ordinary strength of aluminum alloy. In other words, the neutron blocking ability of the aluminum alloy used in such applications should be an adequate required value over the above range of thickness, and addition of extremely large amounts of B or $B_4C$ as described in some previous inventions only serve to unnecessarily worsen workability or decrease ductility.

According to experiments conducted by the inventors of the present invention, in the case of using ordinary $B_4C$ available at an inexpensive price on the market for the B source, optimum characteristics for the target application are only obtained in the case the amount of $B_4C$ added is 2–12% by weight, or 1.5–9% by weight in terms of the amount of B. If the amount of $B_4C$ is less than this amount, the required neutron absorbing power is not obtained. On the other hand, if $B_4C$ is added in excess of the above range, not only does production become difficult due to the formation of cracks and so forth during extrusion and other molding processes, the resulting material has low ductility and is unable to secure the required reliability as a structural material.

In addition, a B or B compound powder is used that preferably has a mean particle size of 1–60 μm. The reason for this is that, since each particle aggregates due to being in the form of a fine powder if the mean particle size is less than 1 μm, the powder ultimately takes on the form of large clumps, thereby preventing the obtaining of a uniform dispersion and having an extremely detrimental effect on yield. If mean particle size exceeds 60 μm, not only does the powder become a contaminant which lowers the material strength and ease of extrusion, it also ends up worsening the cutting workability of the material.

After mixing the above Al or Al alloy powder with the above B or B compound powder, an Al alloy composite material is produced by performing pressurized sintering. Hot extrusion, hot rolling, hot hydrostatic pressing (HIP), hot pressing or any of these combinations can be employed for the pressurized sintering production method.

Furthermore, the preferable heating temperature during pressurized sintering is 350–550° C.

In addition, one of the characteristics of the present invention is that, prior to providing a mixed powder for pressurized sintering, the powder is charged into a can made of Al alloy followed by degassing by heating in a vacuum. If this step is omitted, the amount of gas in the finally obtained material is excessively large, which prevents the desired mechanical properties from being obtained, or causes the formation of blistering in the surface during heat treatment. The preferable temperature range of vacuum heating degassing is 350–550° C. If this is performed below the lower limit temperature, adequate degassing effects are unable to be obtained, and if performed at a temperature higher than the upper limit temperature, characteristics may deteriorate considerable depending on the material.

Following pressurized sintering, heat treatment is performed as necessary. In the case of, for example, using a powder based on an Al—Mg—Si-based aluminum alloy powder, JIS T6 treatment is performed, and in the case of using a powder based on Al—Cu-based Al alloy powder, JIS T6 treatment is also similarly performed. However, in the case of using a powder based on pure Al or Al—Fe-based Al alloy powder, heat treatment is not necessary, and JIS T1 treatment is applicable in such cases.

As a result of employing this production method, an aluminum composite material can be obtained by pressurized sintering that contains in an Al or Al alloy matrix phase a B or B compound having neutron absorbing power in an amount such that the proportion of B is 1.5% by weight or more to 9% by weight or less.

Furthermore, although B or B compounds are known to have superior high-speed neutron absorbing power, a composite material may also be obtained that contains Gd or Gd compound, which has superior low-speed neutron absorbing power, by suitably adding such as necessary.

EXAMPLES

The following provides a detailed explanation of the present invention by indicating specific experimental examples. In this experiment, Al—$B_4C$ particle composite materials were produced by powder metallurgy followed by examination of their mechanical properties.

(1) The Following Four Types were Used as Aluminum or Aluminum Alloy Powder Serving as the Base Base (1): A powder was obtained by air atomization using a pure Al metal having a purity of 99.7%. This is referred to as "pure Al".

Base (2): A powder was obtained by $N_2$ gas atomization using an Al alloy having a standard composition (wt %) of Al—0.6Si—0.25Cu—1.0Mg—0.25Cr (JIS 6061). This was used after classifying to 150 μm or less (mean: 95 μm). This is referred to as "6061Al (Al—Mg—Si series)".

Base (3): A powder was obtained by $N_2$ gas atomization using an Al alloy having a standard composition (wt %) of Al—6.3Cu—0.3Mn—0.06Ti—0.1V—0.18Zr (JIS 2219). This was used after classifying to 150 μm or less (mean: 95 μm). This is referred to as "2219Al (Al—Cu series)".

Base (4): A powder was obtained by $N_2$ gas atomization using an Al—Fe-based Al alloy having a standard composition (wt %) of Al—6Fe. This was used after classifying to 150 μm or less (mean: 95 μm). This is referred to as "Fe-based Al".

(2) Commercially Available $B_4C$ Shown in Table 1 was Used as the Added Particles

TABLE 1

| | Name (Type) | Mean particle size |
|---|---|---|
| (1) | For metal addition | 23 μm |
| (2) | For metal addition | 0.8 μm |
| (3) | #800 for polishing | 9 μm |
| (4) | #280 for polishing | 59 μm |
| (5) | #250 for polishing | 72 μm |

Example 1

<Powders Used>

Here, pure Al powder classified to 250 μm or less (mean: 118 μm), and each of the powders of 6061Al, 2219Al and Fe-based Al classified to 150 μm or less (mean: 95 μm) were used. In addition, $B_4C$ for metal addition having a mean particle size of 23 μm was used as the added particles.

<Sample Production>

(1) In the First Stage, the Above Powders and Added Particles were Mixed for 10–15 Minutes Using a Cross Rotary Mixer Furthermore, in this experiment, although 12 types of samples were produced, the combinations of bases (1) through (4) and added particles (indicated with the value determined by calculating the weight percent of B) are as shown in Table 2.

TABLE 2

| | Mixed powders | | | |
|---|---|---|---|---|
| Sample No. | Base | Amount of $B_4C$ added (as wt % of B) | Heat treatment | Remarks |
| A | Pure Al | 0 | No (T1) | Comparative alloy |
| B | Pure Al | 2.3 | No (T1) | Alloy of present invention |
| C | Pure Al | 4.7 | No (T1) | Alloy of present invention |
| D | Pure Al | 9.0 | No (T1) | Alloy of present invention |
| E | Pure Al | 11.3 | No (T1) | Comparative alloy |
| F | 6061Al | 2.3 | Yes (T6) | Alloy of present invention |
| G | 2219Al | 2.3 | Yes (T6) | Alloy of present invention |
| H | Fe-based Al | 0 | None (T1) | Comparative alloy |
| I | Fe-based Al | 2.3 | None (T1) | Alloy of present invention |
| J | Fe-based Al | 4.7 | None (T1) | Alloy of present invention |
| K | Fe-based Al | 9.0 | None (T1) | Alloy of present invention |
| L | Fe-based Al | 11.3 | None (T1) | Comparative alloy |

In the second stage, a mixture of base powder and added particles is charged into a can and canning is performed. The specifications of the can used here are as shown below.

Material: JIS 6063 (aluminum alloy seamless tube with a bottom plate of the same material welded around its entire circumference)

Diameter: 90 mm

Can thickness: 2 mm

In the third stage, vacuum heating degassing is performed. The canned powder mixture is heated to 480° C. and a vacuum is drawn inside the can to 1 Torr or less and held for 2 hours. As a result of performing this degassing step, gas components and moisture adhered to the surface of the powder inside the can are removed, thereby completing production of the material for extrusion (to be referred to as the billet).

(2) Extrusion

In this step, the billet produced with the above procedure is hot extruded using a 500 ton extruder. The temperature in this case is 430° C., and the billet was molded into an extruded shape in the form of a flat plate as indicated below using an extrusion ratio of about 12.

Extruded shape (cross-section)

Width: 48 mm

Thickness: 12 mm (3) Heat Treatment (T6 Treatment)

In this experiment, heat treatment was only performed on samples F and G shown in Table 2 following extrusion molding.

In the heat treatment of sample F, after performing solution heat treatment for 2 hours at 530° C., the sample was cooled with water followed by aging treatment for 8 hours at 175° C. and cooling in air.

In addition, heat treatment of sample G consisted of solution heat treatment for 2 hours at 530° C. followed by cooling with water, and then aging treatment for 26 hours at 190° C. followed by cooling in air.

Sample production was completed with this heat treatment.

Furthermore, T1 treatment was performed on the other samples consisting of cooling after the hot extrusion step followed by natural aging.

<Evaluation>

Samples A through L produced by going through each of the steps described above were evaluated according to the procedures indicated below.

Furthermore, samples F and G were evaluated using the T6 materials on which the above heat treatment was performed, while the other samples (A through E and H through L) were evaluated using T1 materials on which heat treatment was not performed.

(1) Observation of Microstructure

The microstructure of all samples A through L were observed for the L cross-section (parallel to the direction of extrusion) and T cross-section (perpendicular to the direction of extrusion) at the center of the extruded materials.

As a result, all of the samples were confirmed to have a uniform, fine structure.

(2) Tensile Test

The tensile test was performed under two temperature conditions of room temperature and 250° C.

The tensile test at room temperature was performed on two test pieces (n=2) for all samples A through L. In addition, the tensile test at 250° C. was performed on two test pieces (n=2) for 8 types of samples excluding samples A and C through E.

Furthermore, although all of the tensile tests were performed by using cylindrical test pieces having a diameter at the parallel portion of 6 mm, in the case of tensile tests at 250° C., testing was performed after holding the test piece at 250° C. for 100 hours.

The test results are shown in Table 3.

TABLE 3

| Temperature | Sample No. | Heat treatment | 0.2% yield strength (MPa) | Tensile strength (MPa) | Rupture elongation (%) | Remarks |
|---|---|---|---|---|---|---|
| Room Temperature | A | T1 | 56 | 105 | 40 | Comparative alloy |
| | B | T1 | 62 | 112 | 39 | Alloy of present invention |
| | C | T1 | 64 | 114 | 33 | Alloy of present invention |
| | D | T1 | 70 | 117 | 22 | Alloy of present invention |
| | E | T1 | 80 | 110 | 8 | Comparative alloy |
| | F | T6 | 278 | 307 | 49 | Alloy of present invention |
| | G | T6 | 291 | 426 | 27 | Alloy of present invention |
| | H | T1 | 165 | 262 | 60 | Comparative alloy |
| | I | T1 | 175 | 271 | 21 | Alloy of present invention |
| | J | T1 | 184 | 270 | 18 | Alloy of present invention |
| | K | T1 | 199 | 281 | 13 | Alloy of present invention |
| | L | T1 | 206 | 267 | 5 | Comparative alloy |
| 250° C. (after holding for 100 hours) | B | T1 | 32 | 48 | 36 | Alloy of present invention |
| | F | T6 | 74 | 98 | 23 | Alloy of present invention |
| | G | T6 | 134 | 185 | 13 | Alloy of present invention |
| | H | T1 | 96 | 143 | 23 | Comparative alloy |
| | I | T1 | 107 | 149 | 20 | Alloy of present invention |
| | J | T1 | 107 | 153 | 12 | Alloy of present invention |
| | K | T1 | 112 | 160 | 12 | Alloy of present invention |
| | L | T1 | 115 | 150 | 10 | Comparative alloy |

In looking at the experimental results of Table 3, 0.2% yield strength was within the range of 56 MPa (sample A) to 291 MPa (sample G) at room temperature, and within the range of 32 MPa (sample B) to 134 MPa (sample G) at a high temperature of 250° C.

In addition, tensile strength was within the range of 105 MPa (sample A) to 426 MPa (sample G) at room temperature, and within the range of 48 MPa (sample B) to 185 MPa (sample G) at a high temperature of 250° C. Thus, not only at room temperature, but also at a high temperature, the tensile strength of these samples were superior to the boral tensile strength of 41 MPa (see Table 4).

Continuing, in looking at rupture elongation, values were within the range of 10% (sample L) to 60% (sample H) at room temperature, and within the range of 10% (sample L) to 36% (sample B) at a high temperature of 250° C. Thus, results were demonstrated that were superior to boral elongation of 1.2% (see Table 4) at both temperature conditions.

Figure 2:
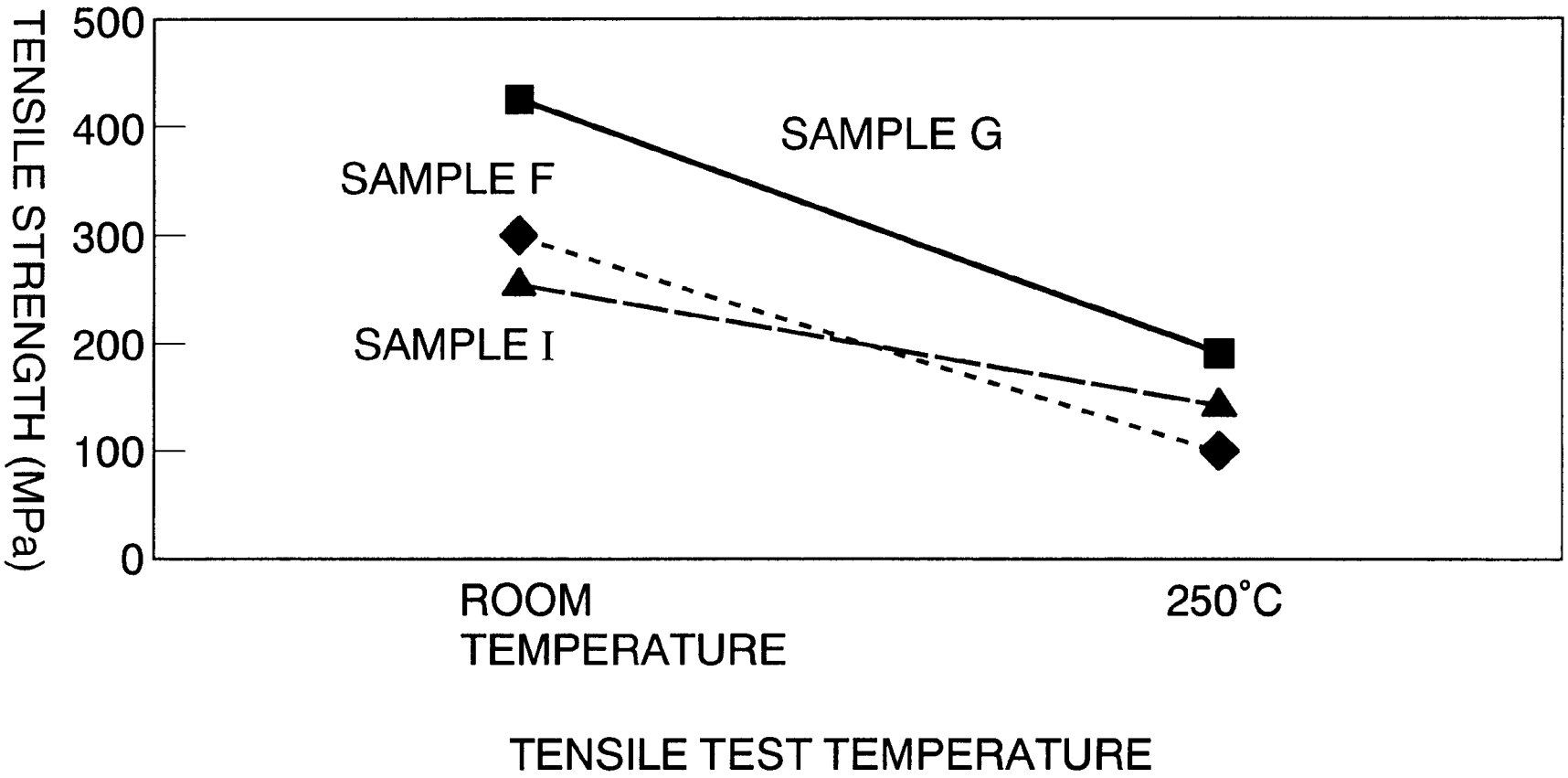
FIG. 2 is a graph relating to the mechanical properties of an Al composite material having neutron absorbing power according to the present invention that shows the relationship between tensile strength (MPa) and temperature (° C.) for samples F, G and I of Table 2.

FIGS. 1 and 2 are graphs showing the effect of temperature on tensile characteristics. Both graphs consist of a plot of the values of samples F, G and I (each containing an added amount of B of 2.3% by weight) based on the test results shown in Table 3. In looking at these graphs, although sample G exhibits the highest values for both 0.2% yield strength and tensile strength, since the slope is relatively large, this sample can be seen to be susceptible to the effects of increasing temperature.

In addition, although sample I exhibited the lowest values at room temperature for both 0.2% yield strength and tensile strength, the slope accompanying rising temperature is the smallest. Consequently, at a high temperature of 250° C., it changes places with sample F, indicating that of the three samples, sample I is least affected by temperature.

Furthermore, the slope of sample F is particularly large for 0.2% yield strength, indicating that it is susceptible to the effects of rising temperature.

Figure 3:
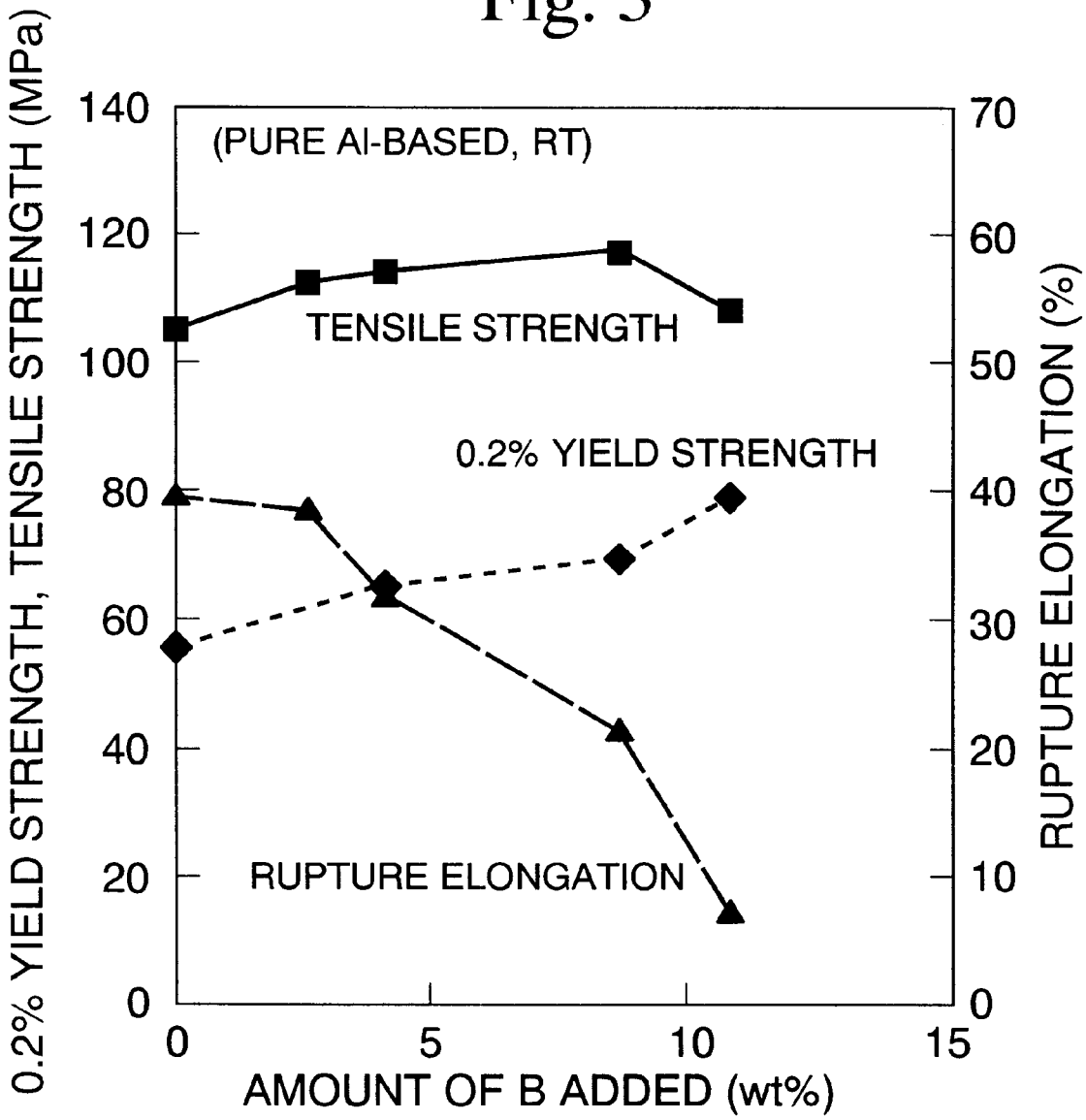
FIG. 3 is a graph relating to the mechanical properties of an Al composite material having neutron absorbing power according to the present invention that shows the effects of the amount of B added at room temperature for pure Al-based composite materials (samples A through E of Table 2).
Figure 4:
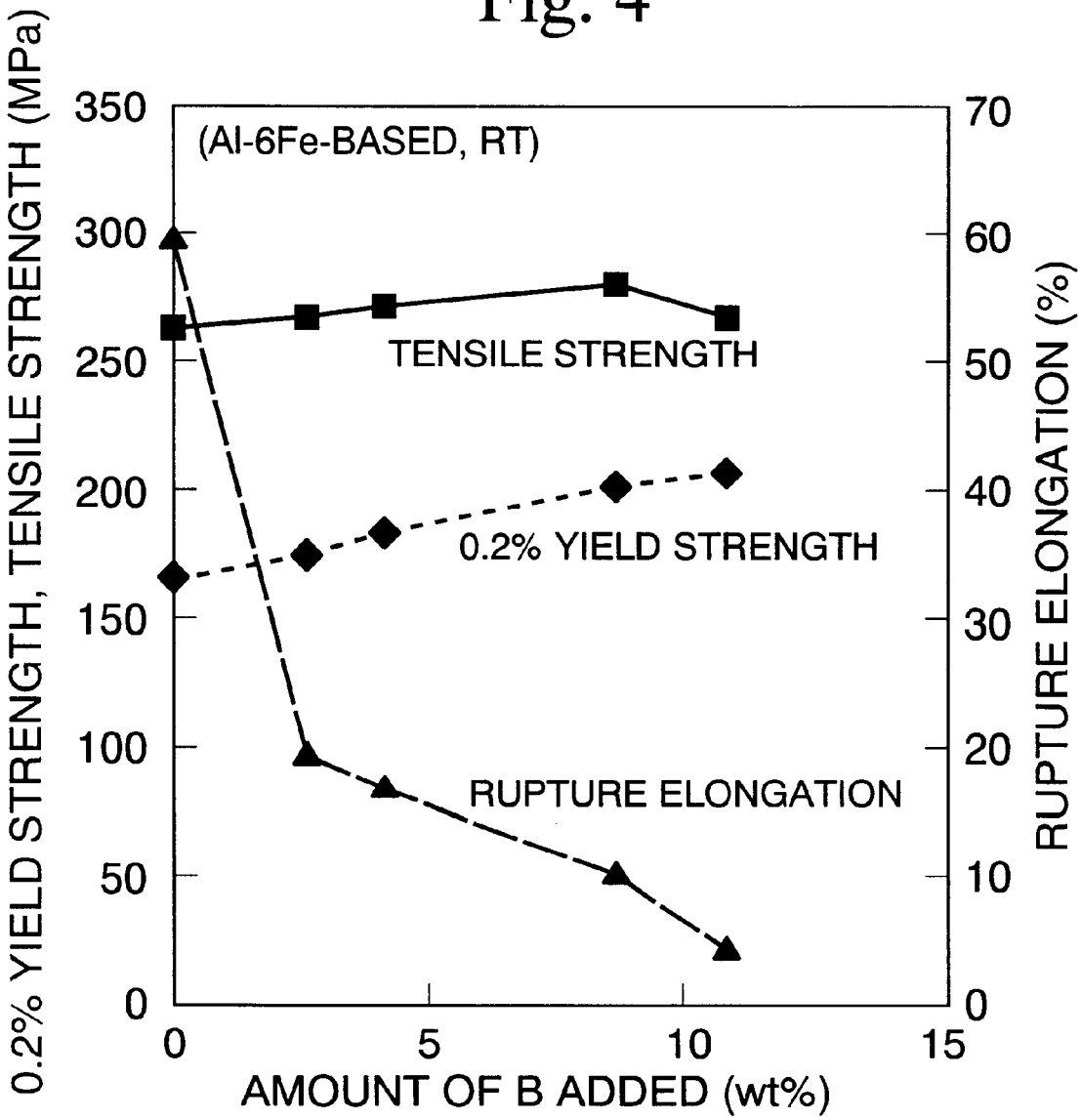
FIG. 4 is a graph relating to the mechanical properties of an Al composite material having neutron absorbing power according to the present invention that shows the effects of the amount of B added at room temperature for Al—6Fe-based composite materials (samples H through L of Table 2).
Figure 5:
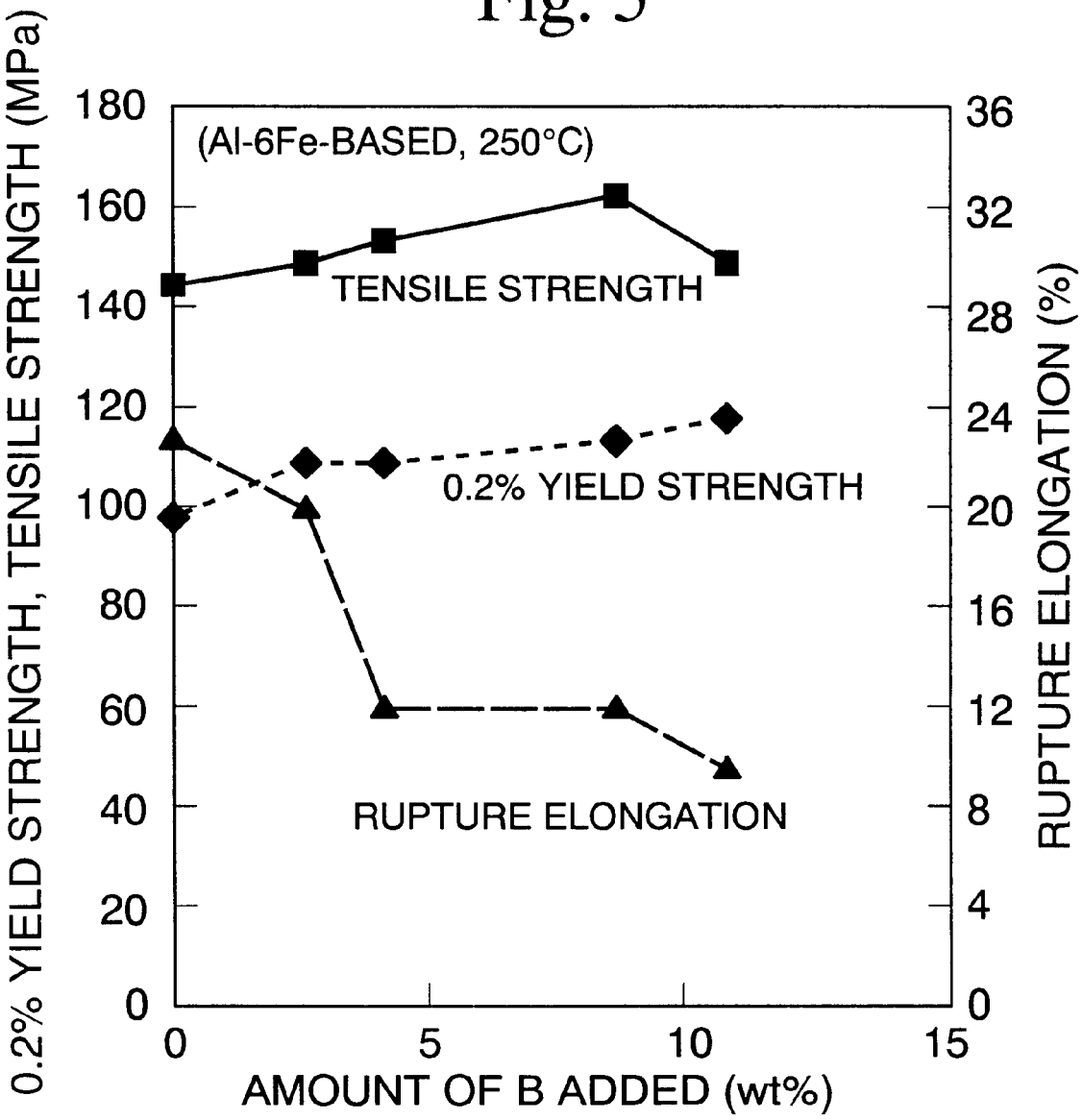
FIG. 5 is a graph relating to the mechanical properties of an Al composite material having neutron absorbing power according to the present invention that shows the effects of the amount of B added at 250° C. for Al—6Fe-based composite materials (samples H through L of Table 2).

Continuing, the graphs of FIGS. 3 through 5 indicate the effect of the amount of B added (wt %) on tensile test results.

FIG. 3 respectively indicates the plots of 0.2% yield strength (MPa), tensile strength (MPa) and rupture elongation (%) (see Table 3) using room temperature conditions for pure Al-based samples A through E. In looking at this graph, as the amount of B added increases, 0.2% yield strength (MPa), indicated with narrow broken lines, and tensile strength (MPa), indicated with a solid line, increase, while conversely, rupture elongation (%), indicated with broke lines, decreases.

FIG. 4 is a graph respectively indicating the plots of 0.2% yield strength (MPa), tensile strength (MPa) and rupture elongation (%) (see Table 3) using room temperature conditions for Fe-based Al (Al—6Fe) samples H through L. In looking at this graph, as the amount of B added increases, 0.2% yield strength (MPa), indicated with narrow broken lines, and tensile strength (MPa), indicated with a solid line, increase in the same manner as FIG. 3. However, although rupture elongation (%), indicated with broken lines, decreases suddenly due to addition of 2.3% by weight B as compared with not adding B, the amount of that decrease is small even when the amount of B added is increased from 2.3% by weight to 4.7% by weight.

FIG. 5 is a graph respectively indicating the plots of 0.2% yield strength (MPa), tensile strength (MPa) and rupture elongation (%) using high temperature conditions of 250° C. for the same Fe-based Al (Al—6Fe) samples H through L as in FIG. 4. In looking at this graph, as the amount of B added increases, 0.2% yield strength (MPa), indicated with narrow broken lines, and tensile strength (MPa), indicated with a solid line, increase in the same manner as in FIGS. 3 and 4. In addition, the phenomenon of FIG. 4 in which rupture elongation (%), indicated with broken lines, decreases suddenly due to addition of B at 2.3% by weight as compared with not adding B is no longer observed, and although the values are low overall, a tendency to decrease gradually with increasing amounts of B is indicated in the same manner as FIG. 3.

It can be confirmed from the above three graphs (FIGS. 3 through 5) that there is a common trend in which, when the amount of $B_4C$ particles exceeds 9% in terms of the amount of B, regardless of the composition of the matrix, 0.2% yield strength is hardly improved at all while rupture elongation decreases suddenly, and accompanying this decrease, tensile strength also decreases. Although all of the materials exhibited higher elongation than, for example, boral (see Table 4), in the case of, for example, assuming that these materials were actually used as structural materials of a nuclear reactor or spend nuclear fuel container, it can be concluded that normal temperature elongation of 10% or more is considered to be the minimum required value in consideration of reliability, and that the amount of $B_4C$ added which is able to satisfy this is 9% or less in terms of the amount of B.

Although there were no problems observed in terms of strength or ductility for those samples containing low amounts of B, since the lower limit of the amount added is determined spontaneously from the required neutron absorbing power, that value is 1.5% by weight as the amount of B as was previously mentioned.

Among the above test results of Table 3, the amount of B (wt %), tensile strength (MPa) and elongation (%) were extracted and shown in the following Table 4 for six types of samples consisting of samples B, C, F, G, I and J (each having an amount of B added of 2.3 or 4.7% by weight). These were then compared with each of the values of products of the prior art obtained by melting methods. Furthermore, the values for tensile strength and elongation shown in Table 4 were obtained at room temperature.

TABLE 4

| Material | Amount of B (wt %) | Tensile strength (MPa) | Elongation (%) |
|---|---|---|---|
| Present Invention | | | |
| Pure Al composite material (Sample B) | 2.3 | 112 | 39 |
| Pure Al composite material (Sample C) | 4.7 | 114 | 33 |
| Al—Mg—Si-based composite material (Sample F) | 2.3 | 307 | 49 |
| Al—Cu-based composite material (Sample G) | 2.3 | 429 | 27 |
| Al—Fe-based composite material (Sample I) | 2.3 | 271 | 21 |
| Al—Fe-based composite material (Sample J) | 4.7 | 270 | 18 |
| Prior art | | | |
| Al—Mg-based alloy | 0.9 | 245 | 20 |
| Al—Mg—Si-based alloy | 0.9 | 270 | 12 |
| Al—Zn—Mg-based alloy | 0.9 | 500 | 11 |
| Al—Cu-based alloy | 0.9 | 370 | 15 |
| Al—Mn-based alloy | 0.9 | 150 | 11 |
| Boral | 27.3 | 41 | 1.2 |

When first comparing the amount of B added, the amount of B added in the articles of the present invention is 2.3 or 4.7% by weight, and because the amount of B added is greater than each of the Al alloys containing 0.9% by weight, these composite materials have high neutron absorbing power. In addition, although the amount of B added in boral is extremely high at 27.3% by weight, since the tensile strength and elongation values described below are extremely low, this material can be understood to lack adequate workability.

Next, in comparing tensile strength, among the articles of the present invention, the pure Al composite material containing 2.3% by weight B (sample B) exhibited the lowest tensile strength of 112 MPa, while among the articles of the prior art, Al—Mn-based alloy demonstrated the lowest tensile strength of 150 MPa. However, since sample B contained a higher added amount of B than the article of the prior art, it has superior neutron absorbing power. In addition, since it also exhibited elongation that was significantly higher than that of the prior art by 20%, it is able to withstand practical use in terms of workability. In comparison with boral in particular, since both tensile strength and elongation characteristics are extremely high, sample B can be understood to be superior in terms of workability.

Furthermore, in the case of limiting the base to Al alloy, the Al—Fe-based composite material containing 4.7% by weight B (sample J) exhibited the lowest value for tensile strength, and that value was 270 MPa.

In addition, the article of the present invention that exhibited the most superior tensile strength was the Al—Cu-based composite material containing 2.3% by weight B (sample G), and that value was 429 MPa. In contrast, although the Al—Zn—Mg-based alloy exhibited the most superior tensile strength among the articles of the prior art at 500 MPa, the elongation in this case was 11%, which is lower than 18%, which is the lowest value among the articles of the present invention shown in Table 4. This trend, namely the trend of having low elongation (11–20%) relative to high tensile strength, is common to aluminum alloys containing B of the prior art, and when the B content is taken into consideration, the elongation of the articles of the prior art can be said to be low overall as compared with the elongation values (18–49%) of the articles of the present invention.

Next, on the basis of Table 4, a comparison is made between aluminum composite materials (articles of the present invention) and aluminum alloys (articles of the prior art) of the same system.

To begin with, when comparing an Al—Mg—Si-based composite material (sample F) and Al—Mg—Si-based alloy, the article of the present invention demonstrated superior values in terms of the amount of B, tensile strength and elongation. Namely, the amount of B was 2.3% by weight as compared with 0.9%, tensile strength was 307 MPa as compared with 270 MPa, and elongation was 49% as compared with 12%, thus indicating that the values for all of these parameters are higher for the article of the present invention.

Continuing, when Al—Cu-based composite material (sample G) was compared with Al—Cu-based alloy, in this case as well, the article of the present invention exhibited superior values for the amount of B, tensile strength and elongation. Namely, the amount of B was 2.3% by weight as compared with 0.9% by weight, tensile strength was 429 MPa as compared with 370 MPa, and elongation was 27% as compared with 15%, thus indicating that the values for all of these parameters are higher for the article of the present invention.

In this manner, since the aluminum composite material of the present invention allows the addition of a large amount of B while also having superior tensile characteristics such as tensile strength and elongation, a high degree of workability can be obtained.

In particular, when considering use as the structural material of a spent nuclear fuel transport container or storage container and so forth, although it is desirable to have mechanical properties of tensile strength of 98 MPa and elongation of 10% or more at 250° C., based on the results of testing at 250° C., use of aluminum alloy powder other than pure Al powder for the base was able to be confirmed to allow this objective to be nearly completely achieved.

Example 2

<Powder Classification>

JIS6N01 composition powder produced by air atomization was classified to various sizes with a sieve. The sieve sizes used along with the mean particle size below the sieve and the classification yield in each case are shown in Table

5.

TABLE 5

| Sieve size (μm) | Mean particle size below sieve (μm) | Classification yield (%) |
|---|---|---|
| 355 | 162 | 99 |
| 250 | 140 | 88 |
| 180 | 120 | 60 |
| 105 | 52 | 21 |
| 45 | 21 | 5 |
| 32 | 5 | 3 |

Although particle size distribution has the potential to fluctuate slightly depending on the alloy composition and atomization conditions, it was able to be confirmed that, as sieve size became smaller, classification yield decreased rapidly. If assuming the premise of using at the industrial level, it must be unavoidably concluded that the use of powder having a particle size of 45 μm or less, at which the classification yield falls to a single digit, would be unrealistic.

<Sample Production>

6N01 powder having each of the particle sizes shown in Table 5 and five types of $B_4C$ particles shown in Table 1 were mixed in the combinations shown in Table 6. The amount of $B_4C$ added was 3% by weight in all cases (2.3% by weight as B), and the mixing time was 10–15 minutes in the same manner as Example 1.

Powder for which mixing was completed was charged into a can following the same procedure as Example 1 followed by vacuum heating degassing and extrusion to obtain an extruded material having a cross-sectional shape measuring 48 mm×12 mm. Heat treatment was not performed.

TABLE 6

| No. | Mean particle size of 6N01 powder used (μm) | Mean particle size of $B_4C$ used (μm) | |
|---|---|---|---|
| 1 | 5 | 9 | Alloy of present invention |
| 2 | 5 | 23 | Alloy of present invention |
| 3 | 5 | 59 | Alloy of present invention |
| 4 | 21 | 9 | Alloy of present invention |
| 5 | 21 | 23 | Alloy of present invention |
| 6 | 21 | 59 | Alloy of present invention |
| 7 | 100 | 9 | Alloy of present invention |
| 8 | 100 | 23 | Alloy of present invention |
| 9 | 100 | 59 | Alloy of present invention |
| 10 | 149 | 9 | Alloy of present invention |
| 11 | 149 | 23 | Alloy of present invention |
| 12 | 149 | 59 | Alloy of present invention |
| 13 | 5 | 0.8 | Comparative alloy |
| 14 | 5 | 72 | Comparative alloy |
| 15 | 149 | 0.8 | Comparative alloy |
| 16 | 149 | 72 | Comparative alloy |
| 17 | 162 | 9 | Comparative alloy |
| 18 | 162 | 59 | Comparative alloy |

<Evaluation>

(1) Observation of Microstructure

The images of the microstructures of L cross-sections (parallel to the direction of extrusion) were analyzed for the respective cross-section centers and exterior portions of the head section, middle section and tail section of each extruded material to investigate localized aggregation of $B_4C$ particles along with overall distribution uniformity.

More specifically, measurement of the surface area ratio of $B_4C$ particles at each observation site was performed for five fields each (with each field measuring 1 mm×1 mm). (Since the specific gravity of $B_4C$ is roughly 2.51, the weight percentage of $B_4C$ in the aluminum alloy can be estimated with Vol %×2.51/2.7 when taking the specific gravity of pure Al to be 2.7. On the other hand, the surface area ratio of $B_4C$ in a cross-section can be assumed to be nearly equal to Vol %. Accordingly, the standard value for the surface area ratio of $B_4C$ is taken to be 3%×2.7/2.51=2.8%.)

In the case there was even one point in a single field at which the $B_4C$ surface area ratio reached twice the standard value (namely, 5.6%), the extruded material was judged to have aggregation, and in the case the mean value of the surface area ratios of 5 fields at each site deviated from the standard value by ±0.5% (namely within the range of 2.3–3.3%), the extruded material was judged to have non-uniform distribution. Those results are shown in Table 7.

TABLE 7

| No. | Mean particle size of 6N01 powder used (μm) | Mean particle size of $B_4C$ used (μm) | Evaluation of $B_4C$ distribution: Aggregation | Non-uniformity | |
|---|---|---|---|---|---|
| 1 | 5 | 9 | No | Uniform | Alloy of present invention |
| 2 | 5 | 23 | No | Uniform | Alloy of present invention |
| 3 | 5 | 59 | No | Uniform | Alloy of present invention |
| 4 | 21 | 9 | No | Uniform | Alloy of present invention |
| 5 | 21 | 23 | No | Uniform | Alloy of present invention |
| 6 | 21 | 59 | No | Uniform | Alloy of present invention |
| 7 | 100 | 9 | No | Uniform | Alloy of present invention |

TABLE 7-continued

| No. | Mean particle size of 6N01 powder used (μm) | Mean particle size of $B_4C$ used (μm) | Evaluation of $B_4C$ distribution | | |
|---|---|---|---|---|---|
| | | | Aggregation | Non-uniformity | |
| 8 | 100 | 23 | No | Uniform | Alloy of present invention |
| 9 | 100 | 59 | No | Uniform | Alloy of present invention |
| 10 | 149 | 9 | No | Uniform | Alloy of present invention |
| 11 | 149 | 23 | No | Uniform | Alloy of present invention |
| 12 | 149 | 59 | No | Uniform | Alloy of present invention |
| 13 | 5 | 0.8 | Yes | Uniform | Comparative alloy |
| 14 | 5 | 72 | No | Non-uniform | Comparative alloy |
| 15 | 149 | 0.8 | Yes | Uniform | Comparative alloy |
| 16 | 149 | 72 | No | Uniform | Comparative alloy |
| 17 | 162 | 9 | No | Uniform | Comparative alloy |
| 18 | 162 | 59 | No | Uniform | Comparative alloy |

In contrast satisfactory $B_4C$ distribution being obtained for all of the alloys of the present invention, in comparative alloys nos. 13 and 15, which used fine $B_4C$ particles having mean particle size of 0.8 μm, local aggregation occurred. In addition, in the case of no. 14, in which coarse $B_4C$ particles having a mean particle size of 72 μm were added to fine Al alloy powder having a mean particle size of 5 μm, non-uniform particle distribution occurred between each site within the extruded material.

remarkable decreases in ductility, and these materials were unable to satisfy the above standard.

In summary of the above results, in order to obtain a material having both a uniform structure free of aggregation of $B_4C$ (namely, uniform neutron absorbing power) and the required ductility for ensuring reliability as a structure material, it was able to be confirmed that it is imperative to control the particle size of the base powder as well as the particle size of the added particles to within the range of the present invention.

TABLE 8

| No. | Mean particle size of 6N01 powder used (μm) | Mean particle size of $B_4C$ used (μm) | Test Results | | | |
|---|---|---|---|---|---|---|
| | | | 0.2% yield strength (MPa) | Tensile strength (MPa) | Rupture elongation (%) | |
| 1 | 5 | 9 | 83 | 151 | 16 | Alloy of present invention |
| 2 | 5 | 23 | 80 | 143 | 13 | Alloy of present invention |
| 3 | 5 | 59 | 73 | 129 | 11 | Alloy of present invention |
| 4 | 21 | 9 | 81 | 153 | 22 | Alloy of present invention |
| 5 | 21 | 23 | 79 | 150 | 19 | Alloy of present invention |
| 6 | 21 | 59 | 71 | 132 | 14 | Alloy of present invention |
| 7 | 100 | 9 | 75 | 148 | 21 | Alloy of present invention |
| 8 | 100 | 23 | 76 | 149 | 15 | Alloy of present invention |
| 9 | 100 | 59 | 76 | 141 | 14 | Alloy of present invention |
| 10 | 149 | 9 | 70 | 143 | 14 | Alloy of present invention |
| 11 | 149 | 23 | 68 | 134 | 12 | Alloy of present invention |
| 12 | 149 | 59 | 62 | 131 | 11 | Alloy of present invention |
| 13 | 5 | 0.8 | 87 | 157 | 21 | Comparative alloy |
| 14 | 5 | 72 | 72 | 123 | 7 | Comparative alloy |
| 15 | 149 | 0.8 | 75 | 147 | 11 | Comparative alloy |
| 16 | 149 | 72 | 56 | 129 | 8 | Comparative alloy |
| 17 | 162 | 9 | 70 | 142 | 9 | Comparative alloy |
| 18 | 162 | 59 | 63 | 125 | 7 | Comparative alloy |

(2) Room Temperature Tensile Test

Each of the produced extruded materials were submitted to tensile testing at room temperature. The shape of the test pieces was the same as in Example 1, namely cylindrical test pieces having a diameter of 6 mm at the parallel portion. The results are shown in Table 8.

As was described in Example 1, when the standard value for acceptance or rejection was taken to be rupture elongation of 10% or more, all of the alloys of the present invention were determined to satisfy this standard. In contrast, in the case of comparative materials nos. 14 and 16, in which coarse $B_4C$ particles having a mean particle size of 72 μm were added, and nos. 17 and 18, in which the mean particle size of the base powder was large at 162 μm, there were

Example 3

<Sample Production>

Billets were produced with the compositions and processes shown in Table 9 and submitted to extrusion at 430° C.

The pure Al and Al—6Fe alloy powder used here were the same as those used in Example 1. The former consisted of air atomized powder classified to 250 μm or less (mean particle size: 118 μm), while the latter consisted of $N_2$ gas atomized powder classified to 150 μm or less (mean particle size: 95 μm). In addition, the $B_4C$ particles used had a mean particle size of 23 μm.

The powder blended into each composition was mixed for 20 minutes with a cross rotary mixer. In the following processes A through E, canning and vacuum heating degassing were performed using the same procedures as Examples 1 and 2 to produce billets that were then submitted to extrusion. At this time, the vacuum degassing temperature was 350° C. in A, 480° C. in B, 550° C. in C, 300° C. in D and 600° C. in E, and extrusion was performed at 430° C. throughout. The extruded shape was the same as in Example 1, measuring 48 mm×12 mm.

In process F, after heating the mixed powder for 2 hours in a furnace at 200° C. in which the pressure was reduced to 4–5 Torr, the powder was filled into a rubber mold in air followed by CIP (cold hydrostatic compression) molding. The resulting molded article had a density of about 75% (porosity: 25%). It was then heated at 430° in air and submitted to extrusion. The extruded shape measured 48 mm×12 mm.

In process G, the mixed powder was CIP molded directly followed by heating to 430° C. in air and extruding. The extruded shape measured 48 mm×12 mm.

TABLE 9

| Powder Used | Amount of $B_4C$ added (wt %) | Process | Remarks |
|---|---|---|---|
| Pure Al | 3 | A (350° C. degassing) | Alloy of present invention |
| (<250 μm) | 3 | B (480° C. degassing) | Alloy of present invention |
| | 3 | C (550° C. degassing) | Alloy of present invention |
| Al—6Fe | 3 | A (350° C. degassing) | Alloy of present invention |
| (<150 μm) | 3 | B (480° C. degassing) | Alloy of present invention |
| | 3 | C (550° C. degassing) | Alloy of present invention |
| Pure Al | 3 | D (300° C. degassing) | Comparative alloy |
| (<250 μm) | 3 | F (degassing without canning) | Comparative alloy |
| | 3 | G (no degassing) | Comparative alloy |
| Al—6Fe | 3 | D (300° C. degassing) | Comparative alloy |
| (<150 μm) | 3 | E (600° C. degassing) | Comparative alloy |

<Evaluation>

Observation of the surface of the extruded materials, room temperature tensile tests in the lengthwise direction, and measurement of the amount of hydrogen gas were performed on each of the extruded materials. Measurement of the amount of gas was performed vacuum melt extrusion-mass analysis in compliance with LIS A06.

The results are shown in Table 10. In contrast to satisfactory results being obtained for extruded material surface properties, mechanical properties and amount of hydrogen gas in materials produced using processes A through C, which are within the scope of claim for patent of the present invention, the following problems occurred in the case of the comparative alloys.

In process D, in which degassing was performed at a temperature lower than the scope of the present invention, hydrogen on the powder surface that was unable to be removed was released during extrusion, causing the so-called "blistering" defect in which air bubbles form immediately beneath the facing of the extruded material.

Although the high strength of the Al—Fe-based alloy was realized by dispersing intermetallic compound particles finely and uniformly due to rapid cooling solidification effects, in process E in which degassing was performed at an extremely high temperature, the mean particle sizes of these compounds increased, causing a sudden decrease in strength and ductility.

In process F, in which degassing was performed without canning, in addition to being unable to avoid a step in which the powder is exposed to the air until the time of extrusion, due to the extremely low degassing temperature, the amount of hydrogen gas was near that of the case of not performing degassing, and together with blistering occurring on the surface of the extruded materials, both strength and ductility exhibited low values.

In process G, in which degassing was not performed, an extremely large amount of hydrogen gas remained, which in addition to causing blistering, resulted in low values for strength and ductility.

On the basis of these results, it was confirmed that, in order to produce Al alloy composite materials having satisfactory characteristics regardless of which matrix alloy is used, it is imperative to use the production method described in the present invention.

TABLE 10

| Matrix | Process | Extruded material surface | Tensile Test: Yield strength (MPa) | Tensile Test: Tensile strength (MPa) | Tensile Test: Elongation (%) | Amount of hydrogen gas (cc/100 g) | Remarks |
|---|---|---|---|---|---|---|---|
| Pure Al | A (350° C. degas) | Good | 58 | 105 | 21 | 9.0 | Alloy of present invention |
| | B (480° C. degas) | Good | 62 | 112 | 39 | 3.1 | Alloy of present invention |
| | C (550° C. degas) | Good | 63 | 114 | 41 | 2.9 | Alloy of present invention |
| Al—6Fe | A (350° C. degas) | Good | 201 | 279 | 10 | 8.8 | Alloy of present invention |
| | B (480° C. degas) | Good | 199 | 281 | 13 | 3.0 | Alloy of present invention |
| | C (550° C. degas) | Good | 195 | 282 | 15 | 2.9 | Alloy of present |
| Pure Al | D (300° C. degas) | Blister | 49 | 88 | 11 | 17.1 | Comparative alloy |
| | F (degas, no can) | Blister | 43 | 79 | 17 | 31.0 | Comparative alloy |
| | G (no degas) | Blister | 41 | 78 | 7 | 39.2 | Comparative alloy |
| Al—6Fe | D (300° C. degas) | Blister | 224 | 291 | 8 | 16.8 | Comparative alloy |
| | E (600° C. degas) | Good | 91 | 127 | 7 | 2.9 | Comparative alloy |

Example 4

3% by weight (2.3% by weight as B) of $B_4C$ particles having a mean particle size of 23 μm were added to a pure Al powder produced by air atomization and classified to 250 μm or less, followed by the production of an extruded material having a cross-sectional shape measuring 48 mm×12 mm using the same method as in Examples 1 and 2. The tensile characteristics of the resulting extruded material consisted of yield strength of 62 MPa, tensile strength of 112 MPa and rupture elongation of 39%.

3% by weight of $B_4C$ was wrapped in aluminum foil and placed into a pure Al melt having a purity of 99.7% melted in a high-frequency melting furnace followed immediately by stirring well in an attempt to produce a composite material. However, due to the extremely poor wettability of the $B_4C$ particles, the majority of the particles ended up floating to the melt surface. Accordingly, production of Al—$B_4C$ composite materials by melt stirring was judged to be difficult.

Pure Al metal having a purity of 99.7% and pure B were blended so that the amount of B was 2.3% by weight, melted in a high-frequency melting furnace and cast into billets having a diameter of 90 mm followed by submitting to extrusion. The extruded shape measured 48 mm×12 mm. Since the melting temperature of B is extremely high at 2092° C., it was considered to be difficult to handle with ordinary Al alloy equipment (even if an intermediate alloy of Al—B is used, although the degree of the problem is different, the problem remains the same). In addition, the resulting extruded material had low elongation of 3.1%, and was judged to be difficult to use as a structural material.

On the basis of the above results, it was able to be confirmed that, in order to obtain a material containing a high concentration of B while also having high strength and ductility, production of a composite material by a powder method is the most feasible as described in the present invention.

INDUSTRIAL APPLICABILITY

The production method of an Al composite material having neutron absorbing power of the present invention as described above offers the advantages described below.

An aluminum composite material produced using a powder metallurgy technique in the form of pressurized sintering after adding B powder or powder of a B compound having neutron absorbing power to an aluminum or aluminum alloy powder and then mixing allows the addition of a large amount (1.5–9% by weight) of B or B compound as compared with melting methods of the prior art.

Consequently, the ability to absorb high-speed neutrons in particular is improved by increasing the amount of B added, and in addition to having high tensile strength at room temperature on the order of 112–426 MPa, an aluminum composite material can be provided that has extremely superior elongation of 13–50%. In addition, this aluminum composite material also has characteristics consisting of tensile strength of 48–185 MPa and elongation of 12–36% even at a high temperature of 250° C. Namely, the use of the present invention makes it possible to obtain an aluminum composite material that is suitable for use as a structural material, which in addition to having high neutron absorbing power, offers superior balance between strength and ductility.

Furthermore, in addition to the each of the characteristics described above, the ability to absorb low-speed neutrons can also be imparted by suitably adding Gd or Gd compound having superior low-speed neutron absorbing power.

What is claimed is:

1. An aluminum composite material having neutron absorbing power, wherein the aluminum composite material contains an Al or an Al alloy matrix phase, wherein the Al or Al alloy is selected from the group consisting of pure aluminum metal, Al—Mg—Si-based alloys, Al—Zn—Mg-based alloys, Al—Fe-based alloys, and Al—Mn-based alloys; and B or a B compound having neutron absorbing power in an amount such that the proportion of B is 1.5% by weight or more to 9% by weight or less, and the aluminum composite material has been pressurized sintered, wherein said pressurized sintering is at least one of hot extrusion, hot rolling, hot hydrostatic pressing and hot pressing.

2. A production method of an aluminum composite material having neutron absorbing power comprising:

adding a B or B compound powder having neutron absorbing power in an amount such that the proportion of B is 1.5% by weight or more to 9% by weight or less to an Al or Al alloy powder, wherein the Al or Al alloy is selected from the group consisting of pure aluminum metal, Al—Mg—Si-based alloys, Al—Zn—Mg-based alloys, Al—Fe-based alloys, and Al—Mn-based alloys; and pressurized sintering the powder, wherein said pressurized sintering is at least one of hot extrusion, hot rolling, hot hydrostatic pressing and hot pressing.

3. The production method of an aluminum composite material having neutron absorbing power according to claim 2, wherein said Al or Al alloy powder is a rapidly solidified powder.

4. The production method of an aluminum composite material having neutron absorbing power according to claim 2, wherein boron carbide ($B_4C$) particles are used as said B compound particles.

5. The production method of an aluminum composite material having neutron absorbing power according to claim 2, wherein the mean particle size of said Al or Al alloy powder is 5 to 150 $\mu$m, and the B compound particles used are $B_4C$ particles having a mean particle size of 1 to 60 $\mu$m.

6. The production method of an aluminum composite material having neutron absorbing power according to claim 2, wherein the powder is charged into a can after heating the inside of the can to contain the powder to 350–550° C. followed by vacuum degassing, and while maintaining the vacuum inside the can, the powder is subjected to pressurized sintering.

7. The production method of an aluminum composite material having neutron absorbing power according to claim 2, wherein heat treatment is performed following said pressurized sintering.

8. The production method of an aluminum composite material having neutron absorbing power according to claim 3, wherein boron carbide ($B_4C$) particles are used as said B compound particles.

9. The production method of an aluminum composite material having neutron absorbing power according to claim 3, wherein the mean particle size of said Al or Al alloy powder is 5 to 150 $\mu$m, and the B compound particles used are $B_4C$ particles having a mean particle size of 1 to 60 $\mu$m.

10. The production method of an aluminum composite material having neutron absorbing power according to claim 4, wherein the mean particle size of said Al or Al alloy powder is 5 to 150 $\mu$m, and the B compound particles used are $B_4C$ particles having a mean particle size of 1 to 60 $\mu$m.

11. The production method of an aluminum composite material having neutron absorbing power according to claim 8, wherein the mean particle size of said Al or Al alloy powder is 5 to 150 $\mu$m, and the B compound particles used are $B_4C$ particles having a mean particle size of 1 to 60 $\mu$m.

12. The production method of an aluminum composite material having neutron absorbing power according to claim 3, wherein the powder is charged into a can after heating the inside of the can to contain the powder to 350–550° C. followed by vacuum degassing, and while maintaining the vacuum inside the can, the powder is subjected to pressurized sintering.

13. The production method of an aluminum composite material having neutron absorbing power according to claim 4, wherein the powder is charged into a can after heating the inside of the can to contain the powder to 350–550° C. followed by vacuum degassing, and while maintaining the vacuum inside the can, the powder is subjected to pressurized sintering.

14. The production method of an aluminum composite material having neutron absorbing power according to claim 5, wherein the powder is charged into a can after heating the inside of the can to contain the powder to 350–550° C. followed by vacuum degassing, and while maintaining the vacuum inside the can, the powder is subjected to pressurized sintering.

15. The production method of an aluminum composite material having neutron absorbing power according to claim 8, wherein the powder is charged into a can after heating the inside of the can to contain the powder to 350–550° C. followed by vacuum degassing, and while maintaining the vacuum inside the can, the powder is subjected to pressurized sintering.

16. The production method of an aluminum composite material having neutron absorbing power according to claim 3, wherein heat treatment is performed following said pressurized sintering.

17. The production method of an aluminum composite material having neutron absorbing power according to claim 4, wherein heat treatment is performed following said pressurized sintering.

18. The production method of an aluminum composite material having neutron absorbing power according to claim 5, wherein heat treatment is performed following said pressurized sintering.

19. The production method of an aluminum composite material having neutron absorbing power according to claim 8, wherein heat treatment is performed following said pressurized sintering.

20. An aluminum composite material having neutron absorbing power, wherein the aluminum composite material contains an Al or an Al alloy matrix phase, $B_4C$ having neutron absorbing power in an amount such that the proportion of B is 1.5% by weight or more to 9% by weight or less, and the aluminum composite material has been obtained by adding $B_4C$ particles having a mean particle size of 1 to 60 $\mu$m to Al or Al alloy powder having a mean particle size of said is 5 to 150 $\mu$m, and then pressure sintering, wherein said pressurized sintering is at least one of hot extrusion, hot rolling, hot hydrostatic pressing and hot pressing.

21. An aluminum composite material having neutron absorbing power, wherein the aluminum composite material contains an Al or an Al alloy matrix phase, B or a B compound having neutron absorbing power in an amount such that the proportion of B is 1.5% by weight or more to 9% by weight or less, and the aluminum composite material has been obtained by adding the B or B compound powder to the Al or Al alloy powder, charging the powder into a can after heating the inside of the can to contain the powder to 350–550° C. followed by vacuum degassing, and while maintaining the vacuum inside the can, subjecting the powder to pressurized sintering, wherein said pressurized sintering is at least one of hot extrusion, hot rolling, hot hydrostatic pressing and hot pressing.

22. The aluminum composite material according to claim 20, wherein heat treatment is performed following said pressurized sintering.

23. The aluminum composite material according to claim 21, wherein heat treatment is performed following said pressurized sintering.

24. The aluminum composite material according to claim 1, wherein pure aluminum metal is used as the matrix.

25. The aluminum composite material according to claim 1, wherein an Al alloy selected from the group consisting of Al—Mg—Si, Al—Zn—Mg, Al—Fe, and Al—Mn based alloys is used as the matrix.

26. The production method of an aluminum composite material having neutron absorbing power according to claim 2, wherein an Al alloy selected from the group consisting of Al—Mg—Si, Al—Zn—Mg, Al—Fe, and Al—Mn based alloys is used as the matrix.

27. The aluminum composite material according to claim 1, which has a thickness of from about 5 to 30 mm.

28. An aluminum composite material having neutron absorbing power, wherein the aluminum composite material contains an Al alloy matrix phase, wherein the Al alloy is selected from the group consisting of Al—Mg—Si-based alloys; and B or a B compound having neutron absorbing power in an amount such that the proportion of B is 1.5% by weight or more to 5% by weight or less, and the aluminum composite material has been pressurized sintered, wherein said pressurized sintering is at least one of hot extrusion, hot rolling, hot hydrostatic pressing and hot pressing.

29. A production method of an aluminum composite material having neutron absorbing power comprising:

adding a B or B compound powder having neutron absorbing power in an amount such that the proportion of B is 1.5% by weight or more to 5% by weight or less to an Al alloy powder, wherein the Al alloy is selected from the group consisting of Al—Mg—Si-based alloys; and pressurized sintering the powder, wherein said pressurized sintering is at least one of hot extrusion, hot rolling, hot hydrostatic pressing and hot pressing.

* * * * *